US011483908B1

(12) United States Patent
Wang

(10) Patent No.: US 11,483,908 B1
(45) Date of Patent: Oct. 25, 2022

(54) 3-WAY DIMMING BRIGHTNESS AND COLOR TEMPERATURE CONTROL

(71) Applicant: Tiejun Wang, Lin'an (CN)

(72) Inventor: Tiejun Wang, Lin'an (CN)

( * ) Notice: Subject to any disclaimer, the term of this patent is extended or adjusted under 35 U.S.C. 154(b) by 0 days.

(21) Appl. No.: 17/329,397

(22) Filed: May 25, 2021

(51) Int. Cl.

| | |
|---|---|
| ***H05B 45/20*** | (2020.01) |
| ***H05B 45/46*** | (2020.01) |
| ***H05B 45/10*** | (2020.01) |
| ***H05B 47/19*** | (2020.01) |
| *H05B 47/195* | (2020.01) |

(52) U.S. Cl.
CPC ..... *H05B 45/20* (2020.01); *H05B 45/10* (2020.01); *H05B 45/46* (2020.01); *H05B 47/19* (2020.01); *H05B 47/195* (2020.01)

(58) Field of Classification Search
None
See application file for complete search history.

(56) References Cited

U.S. PATENT DOCUMENTS 10,624,189 B1 * 4/2020 Wang ..... F21V 23/003
2017/0374718 A1 * 12/2017 Fang ..... H05B 45/46

FOREIGN PATENT DOCUMENTS

WO WO-2017189571 A1 * 11/2017 ..... H05B 45/10

* cited by examiner

*Primary Examiner* — Dedei K Hammond
(74) *Attorney, Agent, or Firm* — Daniel M. Cohn; Howard M. Cohn

(57) ABSTRACT

Disclosed embodiments provide a luminaire device including a power supply, and a three-way light module installed within a housing. The device includes an input end which is connected to the power grid, and an output end is connected to a three-way LED light module through the power supply and a control module, and an LED driver. The group corresponds to the series connection current module. The device also includes a dimmer, the output of the dimmer is connected to the power input of the lamp, and the power output is passed through a signal detection unit. A centralized control unit such as a microcontroller receives the adjustable signal of the dimmer, and the controller controls the current modules of the 3 LED modules. This enabled the feature of precise adjustments of brightness and correlated color temperature (CCT) of the device.

18 Claims, 7 Drawing Sheets

3-WAY DIMMING BRIGHTNESS AND COLOR TEMPERATURE CONTROL

FIELD

The present invention relates generally to lighting control, and more particularly to 3-way dimming brightness and color temperature control.

BACKGROUND

Light Emitting Diode (LED) lighting is currently available in a wide variety of home and industrial products. The rapid development of LED technology leads to more products and improved manufacturing efficiency, which also results in lower prices. The reduced power requirements as compared with incandescent lighting enables portable lighting applications such as flashlights, vehicle lights, and more.

Color temperature defines the color appearance of a white LED. CCT is defined in degrees Kelvin; a warm light is around 2700K, moving to neutral white at around 4000K, and to cool white, at 5000K or more. Since it is a single number, CCT is simpler to communicate than chromaticity or SPD, leading the lighting industry to accept CCT as a shorthand means of reporting the color appearance of "white" light emitted from electric light sources.

Lighting plays an important role in the design and usability of interior spaces. Different situations may call for different lighting conditions. For example. the ideal lighting for use while preparing a meal in the kitchen may be different from the ideal lighting for watching a movie after dinner. It is therefore desirable to have improvements in lighting control.

SUMMARY

Embodiments include an apparatus comprising: a dimmer configured and disposed to provide an input signal to an LED driver; a signal detection unit configured and disposed to receive an output signal from the LED driver; a controller configured to provide power to: a first light-emitting device that is configured to emit a first white light of a first correlated color temperature (CCT); a second light-emitting device that is configured to emit a second white light of a second CCT; a third light-emitting device that is configured to emit a third white light of a third CCT, wherein the light from the first, second, and third light-emitting devices mix to form a combined-light CCT; receive an output signal from the signal detection unit, wherein the output signal from the signal detection unit is proportional to the input signal provided by the dimmer; in response to receiving a user-adjustable electronic signal Vin from the signal detection unit, adjusting output current of a first current control module, wherein the first current control module is electrically coupled to the first light-emitting device, adjusting output current of a second current control module, wherein the second control module is electrically coupled to the second light-emitting device, and adjusting output current of a third current control module, wherein the third current control module is electrically coupled to the third light-emitting device, and wherein the first current control module, second current control module, and third current control module are each adjustable independently; and distribute supply power to the first, second, and third light-emitting devices according to a power-distribution scheme that is based on the level of Vin.

Additional embodiments include an apparatus comprising: a dimmer configured and disposed to provide an input signal to an LED driver; a signal detection unit configured and disposed to receive an output signal from the LED driver; a controller configured to provide power to: a first light-emitting device that is configured to emit a first white light of a first correlated color temperature (CCT); a second light-emitting device that is configured to emit a second white light of a second CCT; a third light-emitting device that is configured to emit a third white light of a third CCT; receive an output signal from the signal detection unit, wherein the output signal from the signal detection unit is proportional to the input signal provided by the dimmer; in response to receiving a user-adjustable electronic Vin signal from the signal detection unit, adjusting output current of a first current control module, wherein the first current control module is electrically coupled to the first light-emitting device, adjusting output current of a second current control module, wherein the second control module is electrically coupled to the second light-emitting device, and adjusting output current of a third current control module, wherein the third current control module is electrically coupled to the third light-emitting device, and wherein the first current control module, second current control module, and third current control module are each adjustable independently; and distribute supply power to the first, second, and third light-emitting devices according to a power-distribution scheme that is based on the level of Vin, and wherein the signal detection unit, first current control module, second current control module, and third current control module are integrated into a single device.

BRIEF DESCRIPTION OF THE DRAWINGS

The structure, operation, and advantages of the present invention will become further apparent upon consideration of the following description taken in conjunction with the accompanying figures (FIGs.). The figures are intended to be illustrative, not limiting.

Certain elements in some of the figures may be omitted, or illustrated not-to-scale, for illustrative clarity. The cross-sectional views may be in the form of "slices", or "near-sighted" cross-sectional views, omitting certain background lines which would otherwise be visible in a "true" cross-sectional view, for illustrative clarity.

Figure 1:
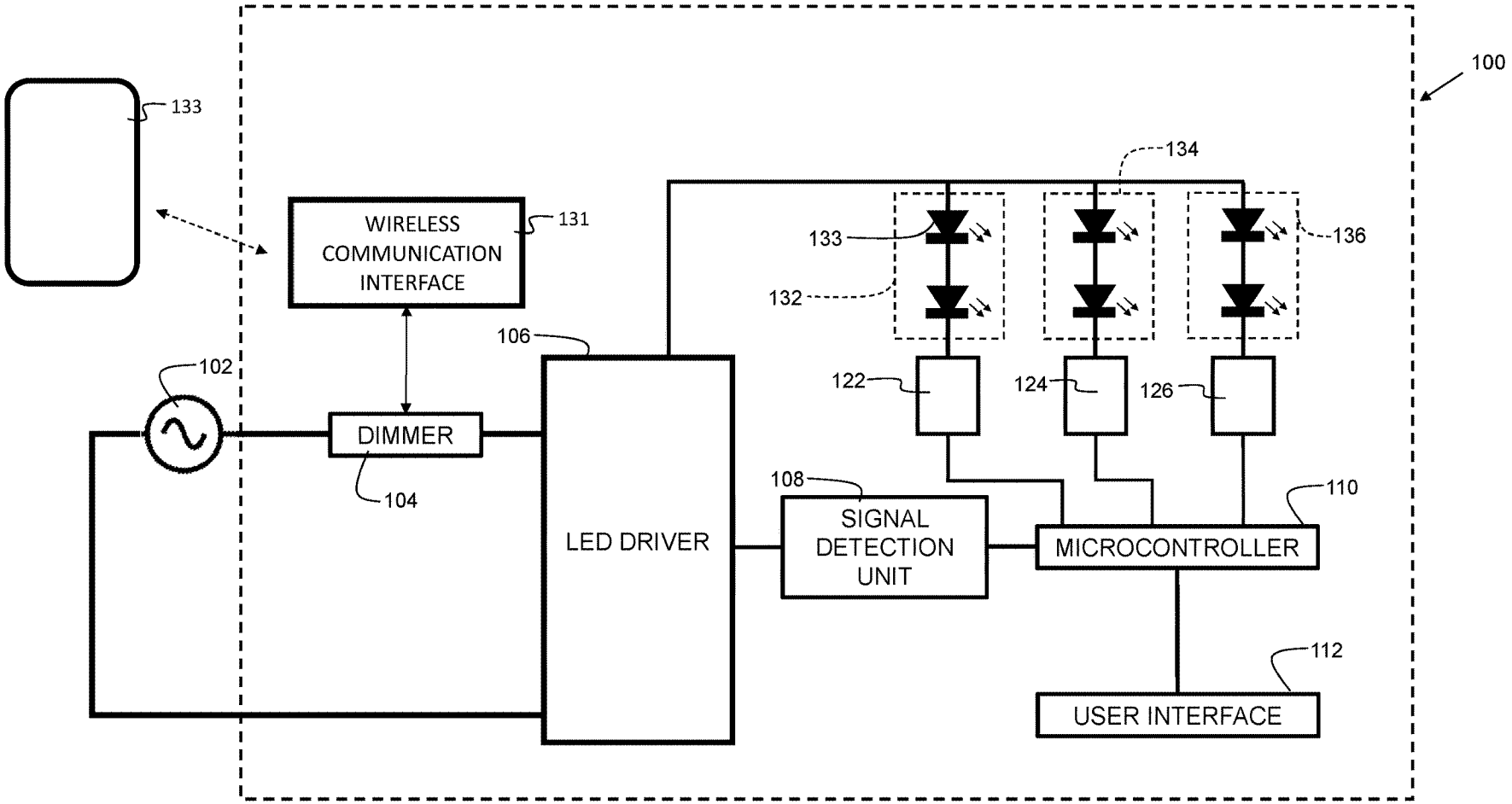

In some cases, similar elements may be referred to by similar numbers in various figures (FIGs) of the drawing, in which case typically the last two significant digits may be the same, the most significant digit being the number of the drawing figure (FIG). Furthermore, for clarity, some reference numbers may be omitted in certain drawings.

FIG. 1 is a diagram of an embodiment of the present invention.

Figure 2:
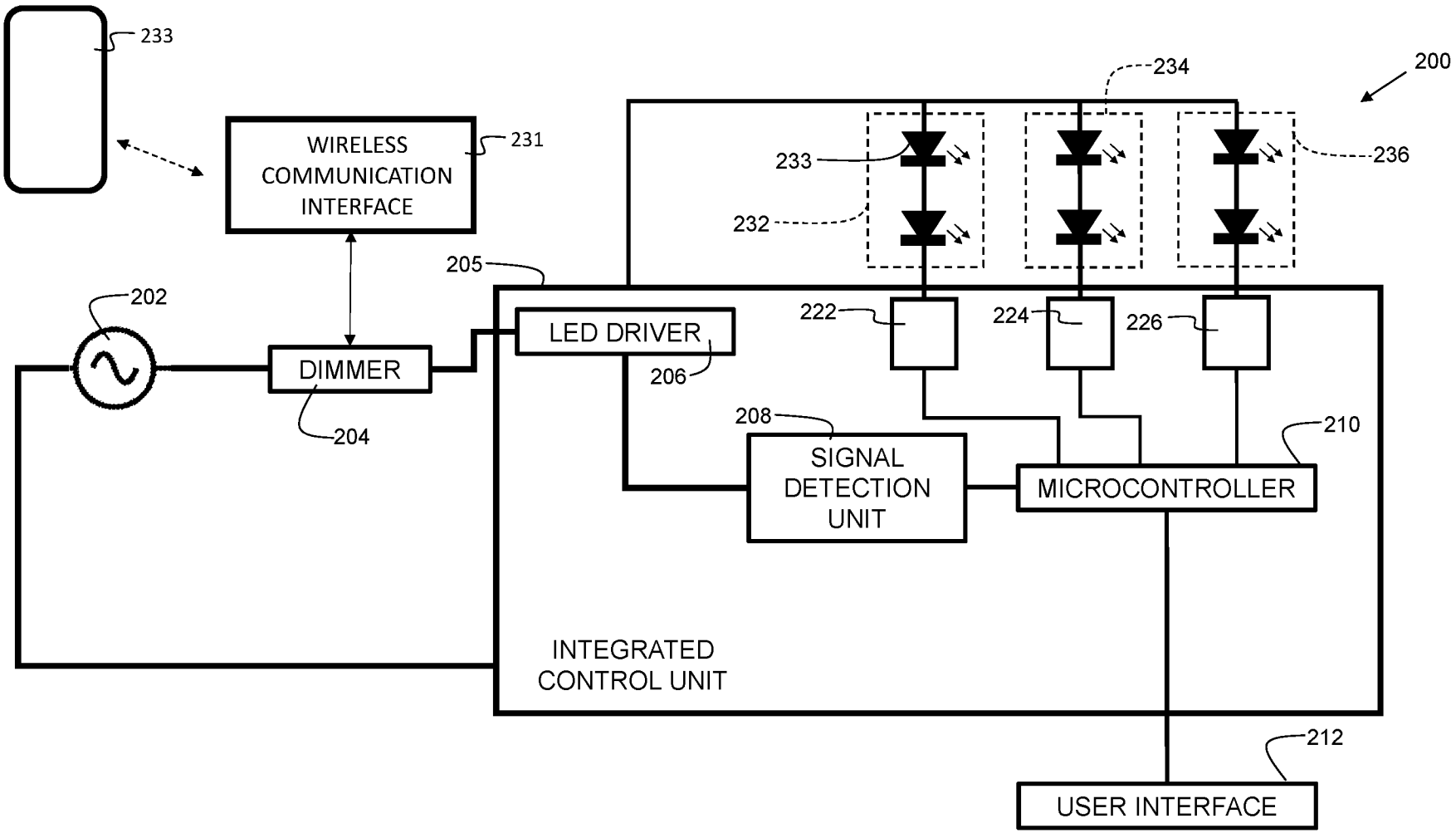

FIG. 2 is a diagram of an additional embodiment of the present invention.

Figure 3:
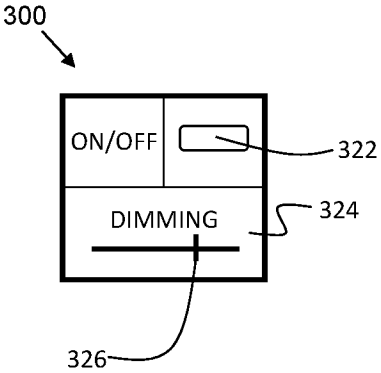

FIG. 3 shows a dimmer in accordance with embodiments of the present invention.

Figure 4:
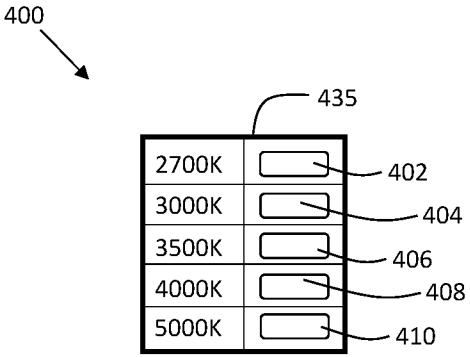

FIG. 4 shows a CCT user control in accordance with embodiments of the present invention.

Figure 5:
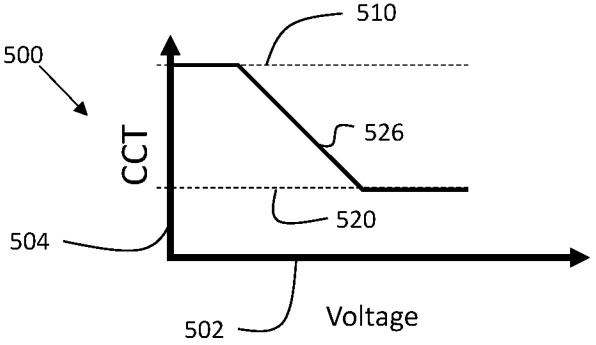

FIG. 5 illustrates a relationship between a dimmer signal and a correlated color temperature in some embodiments.

Figure 6:
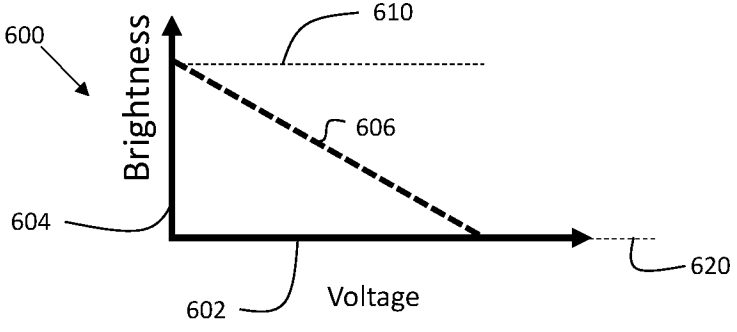

FIG. 6 illustrates a relationship between a dimmer signal and brightness in some embodiments.

Figure 7:
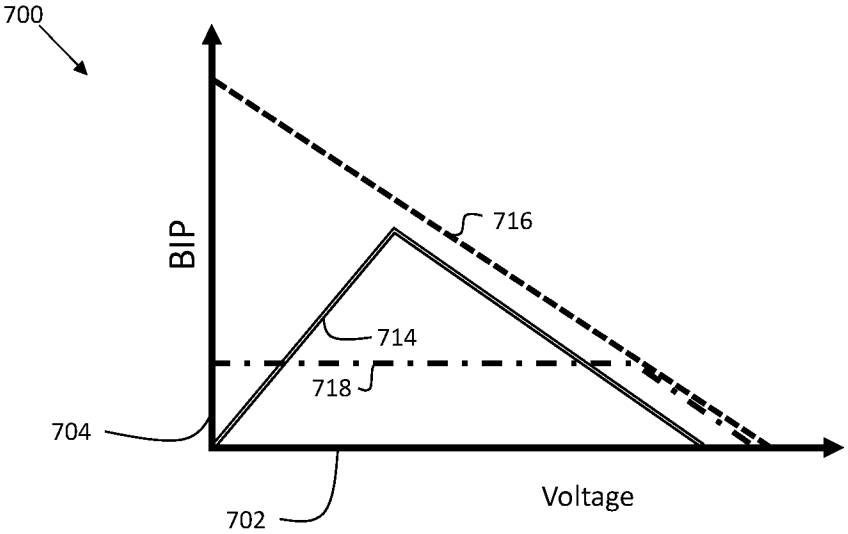

FIG. 7 illustrates a relationship between a dimmer signal, and brightness/power/current of three light-emitting devices in accordance with embodiments of the present invention.

Figure 8:
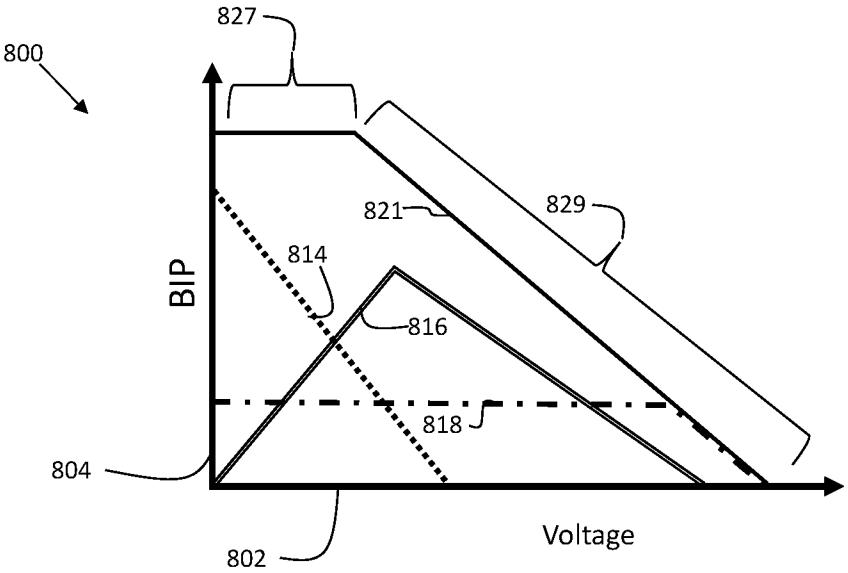

FIG. 8 shows a combined brightness, current, and power curve in accordance with embodiments of the present invention.

Figure 9:
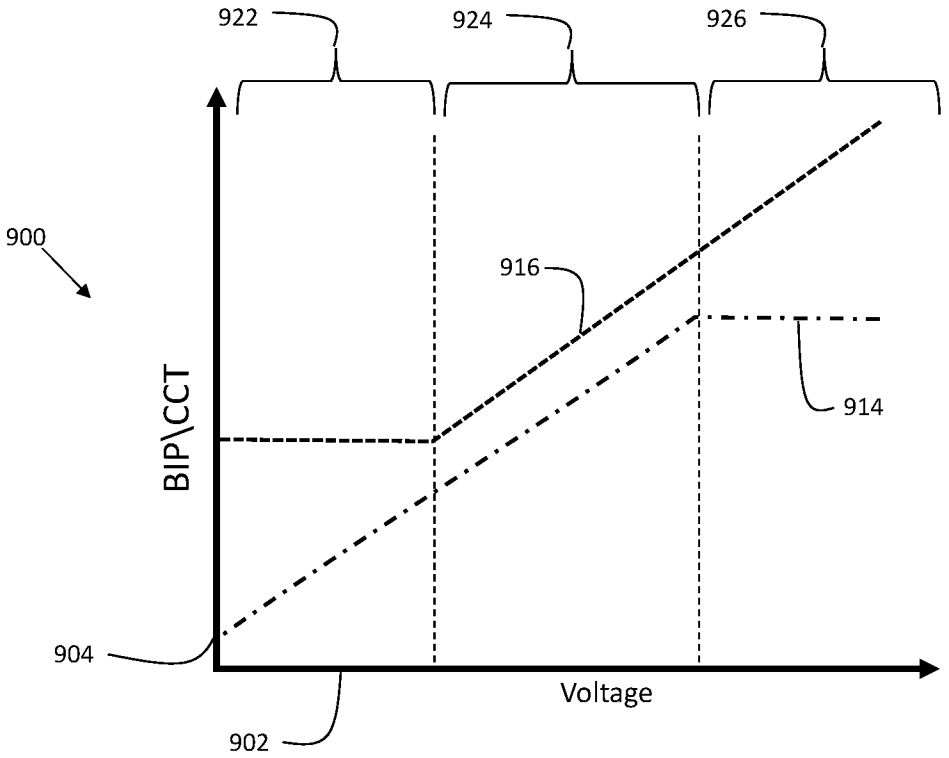

FIG. 9 shows a relationship between a dimmer signal, brightness/power/current, and a correlated color temperature in some embodiments.

DETAILED DESCRIPTION

Disclosed embodiments provide a luminaire device including a power supply, and a three-way light module installed within a housing. The device includes an input end which is connected to the power grid, and an output end which is connected to a three-way LED light module through the power supply and a control module, and an LED driver. The group corresponds to the series connection current module. The device also includes a dimmer, the output of the dimmer is connected to the power input of the lamp, and the power output is passed through a signal detection unit. A centralized control unit such as a microcontroller receives the adjustable signal of the dimmer, and the controller controls the current modules of the 3 LED modules. This enabled the feature of precise adjustments of brightness and correlated color temperature (CCT) of the device. The control module may also include an interface for setting the corresponding color temperature or brightness and other functions. In another embodiment, the control module can be integrated into the power supply.

FIG. 1 is a diagram of an embodiment of the present invention. Apparatus 100 includes a dimmer 104. The dimmer 104 is coupled to an alternating current (AC) power source 102 (e.g., 120 VAC). The dimmer 104 can be a TRIAC, trailing edge dimmer, or other suitable dimmer type. The dimmer 104 provides a conditioned signal as an input to LED driver 106. LED driver 106 carefully controls the current delivered to three LED light-emitting devices, indicated as 132, 134, and 136. In embodiments, the light from the first, second, and third light-emitting devices mix to form a combined-light CCT, and a combined-light brightness.

Each light-emitting device includes one or more LED devices, indicated generally as 133. The LED driver 106 also provides a dimming signal to signal detection unit 108. Signal detection unit 108 which conditions the signal for input to microcontroller 110. In embodiments, the signal output from signal detection unit 108 is a user-adjustable electronic signal Vin, based on the settings of dimmer 104. Microcontroller 110 includes multiple General-Purpose Input/Output (GPIO) pins for receiving inputs and producing outputs to implement various features of disclosed embodiments. In response to receiving an input signal from the signal detection unit 108, the microcontroller 110 controls current control modules 122, 124, and 126. Current control module 122 is coupled to light-emitting device 132. Current control module 124 is coupled to light-emitting device 134. Current control module 126 is coupled to light-emitting device 136.

The microcontroller 110 executes machine instructions that control the brightness and/or CCT output of each light-emitting device (132, 134, and 136) independently in order to achieve a desired lighting effect including a brightness and/or CCT value. Thus, in embodiments, the first current control module, second current control module, and third current control module are each adjustable independently.

Optionally, a user interface (CCT user control) 112 may be used to specify a desired CCT value. The user interface 112 provides an input to microcontroller 110 that is indicative of a user-specified CCT value. The microcontroller may utilize a formula, lookup table, and/or other suitable techniques in order to derive appropriate levels for current control modules 122, 124, and 126 based on the settings of dimmer 104 and/or the CCT value specified by user interface 112.

Optionally, apparatus 100 may further include a wireless communication interface 131 to enable control of the apparatus 100 via a remote device 133. In some embodiments, wireless communication interface 131 may include a radio transceiver, such as a Wi-Fi transceiver and/or a Bluetooth transceiver. In some embodiments, remote device 133 may be a smartphone or tablet computer that utilizes Wi-Fi or Bluetooth to provide desired dimming and/or CCT values to apparatus 100. In some embodiments, the wireless communication interface 131 may include an infrared receiver, and remote device 133 may include an infrared transmitter, in order to provide desired dimming and/or CCT values to apparatus 100. Thus, in embodiments, the wireless communication interface includes an infrared interface, Wi-Fi interface, and/or Bluetooth interface.

FIG. 2 is a diagram of an additional embodiment of the present invention. Apparatus 200 includes an integrated control unit 205. The integrated control unit 205 houses an LED driver 206. LED driver 206 carefully controls the current delivered to three LED light-emitting devices, indicated as 232, 234, and 236. Each light-emitting device includes one or more LED devices, indicated generally as 233.

Each light-emitting device includes one or more LED devices, indicated generally as 233. The LED driver 206 also provides a dimming signal from dimmer 204 to signal detection unit 208. The dimmer 204 can be a TRIAC, trailing edge dimmer, or other suitable dimmer type. The dimmer is connected to AC power source 202 (e.g., 120 VAC). Signal detection unit 208 conditions the signal for input to microcontroller 210. In embodiments, the signal output from signal detection unit 208 is a user-adjustable electronic signal Vin, based on the settings of dimmer 204. Microcontroller 210 includes multiple General-Purpose Input/Output (GPIO) pins for receiving inputs and producing outputs to implement various features of disclosed embodiments. In response to receiving an input signal from the signal detection unit 208, the microcontroller 210 controls current control modules 222, 224, and 226. Current control module 222 is coupled to light-emitting device 232. Current control module 224 is coupled to light-emitting device 234. Current control module 226 is coupled to light-emitting device 236.

The microcontroller 210 executes machine instructions that control the brightness and/or CCT output of each light-emitting device (232, 234, and 236) independently in order to achieve a desired lighting effect including a brightness and/or CCT value. Optionally, a user interface (CCT user control) 212 may be used to specify a desired CCT value. The user interface 212 provides an input to microcontroller 210 that is indicative of a user-specified CCT value. The microcontroller may utilize a formula, lookup table, and/or other suitable techniques in order to derive appropriate levels for current control modules 222, 224, and 226 based on the settings of dimmer 204 and/or the CCT value specified by user interface 212.

The microcontroller 210 executes machine instructions that control the brightness and/or CCT output of each light-emitting device (232, 234, and 236) independently in order to achieve a desired lighting effect including a brightness and/or CCT value. Optionally, a user interface (CCT user control) 212 may be used to specify a desired CCT value. The user interface 212 provides an input to microcontroller 210 that is indicative of a user-specified CCT value. The microcontroller may utilize a formula, lookup table, and/or other suitable techniques in order to derive appropriate levels for current control modules 222, 224, and 226 based on the settings of dimmer 204 and/or the CCT value specified by user interface 212.

Optionally, a wireless communication interface 231 may be coupled to dimmer 204 in order to enable control of the apparatus 200 via a remote device 233. In some embodiments, wireless communication interface 231 may include a radio transceiver, such as a Wi-Fi transceiver and/or a Bluetooth transceiver. In some embodiments, remote device 233 may be a smartphone or tablet computer that utilizes Wi-Fi or Bluetooth to provide desired dimming and/or CCT values to apparatus 200. In some embodiments, the wireless communication interface 131 may include an infrared receiver, and remote device 233 may include an infrared transmitter, in order to provide desired dimming and/or CCT values to apparatus 200. In embodiments, the signal detection unit, first current control module, second current control module, and third current control module are integrated into a single device.

FIG. 3 shows a dimmer 300 in accordance with embodiments of the present invention. Dimmer 300 may include an on/off switch 322, and a dimming control 324. In this example, the on/off switch 322 is in the form of a rocker switch. When the on/off switch 322 is in an ON state, the dimmer switch 300 output is a function of the position of the slider-type user-interface component. In contrast, when the on/off switch 322 is in an OFF state, the dimmer switch 300 output might be open circuit, or at the voltage-range's first end voltage (i.e., 0VDC).

Dimming control 324 includes a slider 326 that can be moved by a user to adjust a desired brightness of the light-emitting devices shown in FIG. 1 or FIG. 2. Embodiments may include an alternative dimming control that uses a rotary knob, touchscreen, capacitive switch, or other suitable control in place of the slider 326. The slider 326 may be coupled to a TRIAC, potentiometer, and/or other circuitry to control an output signal as a function of slider position along a linear track. The potentiometer (variable resistor) might change the Vin value to specify the color temperature and dimming. Thus, the dimmer 300 is user-adjustable in that the slider 326 can be moved by a user (e.g., by the user's finger) across an operational full-scale range from a first end of the operational range to an opposite second end of the operational full-scale range. This range is "operational full-scale" in that it defines a full-scale range of positions and values that the dimmer 300 is capable of providing when the dimmer is operating as intended and designed. Thus, in embodiments, the dimmer includes a slider control. In embodiments, the dimmer 300 may be integrated into a wall switch.

In the above example, the user-interface components (slider 326) include physical components that can be grasped and moved by a user. In some embodiments, the dimmer 300 is configured to be wall-mounted and installed in an electrical box.

In other embodiments, the user-interface component is instead displayed, such as on a display screen (e.g., of remote device 133 and/or 233). An example of a displayed user-interface component is a virtual component, i.e., an image (e.g., on a touchscreen) that simulates a physical component, such as a virtual (displayed image of) a slider or a knob. Virtual user-adjustable components might be moved by the user swiping the virtual component on a touch screen or by the user grabbing-and-moving the virtual component with a mouse.

The output of dimmer 300 might have any full-scale voltage range. More specifically, the first end of the full-scale voltage range might be any voltage, for example, 0V or −1V. And the second end of the full-scale voltage range might be any other voltage, for example 1V or 10V. However, to simplify the following explanation of the controller's operation, the dimmer's output voltage is exemplified as having a full-scale range of 0-10V, such that the range's first end is simply designated 0V and the voltage range's second end is simply designated 10V. Thus, in embodiments, the dimmer 300 provides a user-adjustable DC (direct current) input voltage Vin.

FIG. 4 shows a CCT user control 400 in accordance with embodiments of the present invention. In embodiments, the CCT user control 400 comprises a plurality of buttons disposed within a housing 435, the buttons indicated as 402-410. Each button may configure a different resistance, resulting in a different voltage input to an input pin of the microcontroller (110 or 210). Button 402 may correspond to a first resistance, creating a voltage level which corresponds to a CCT value of 2700K. Button 404 may correspond to a second resistance, creating a voltage level which corresponds to a CCT value of 3000K. Button 406 may correspond to a third resistance, creating a voltage level which corresponds to a CCT value of 3500K. Button 408 may correspond to a fourth resistance, creating a voltage level which corresponds to a CCT value of 4000K. Button 410 may correspond to a fifth resistance, creating a voltage level which corresponds to a CCT value of 5000K. Other resistance values may be used to allow selection of other CCT values. Additionally, one or more sliders, knobs, dials, switches, buttons, or other suitable controls may be included to allow selection of one or more resistance values that correspond to a CCT value for a combined white light from multiple light-emitting devices. The voltage level created by activation of one of the buttons (402-410) is detected by an input pin of the microcontroller (110 or 210). In response to the detecting of the voltage level, the microcontroller adjusts the light-emitting devices accordingly to achieve a desired combined-light CCT value. Thus, in embodiments, the user control comprises a plurality of preset CCT buttons.

FIG. 5 illustrates a relationship between a dimmer signal and a correlated color temperature in some embodiments. Graph 500 includes a horizontal axis 502 representing voltage and a vertical axis 504 representing CCT. Curve 526 transitions from a maximum value indicated at 510 to a minimum value indicated at 520. In some embodiments, for at least one voltage region, the CCT value remains constant, while in at least one voltage region, the CCT varies as a function of voltage. The voltage can be a Vin voltage from a dimmer or signal detection unit.

FIG. 6 illustrates a relationship between a dimmer signal and brightness in some embodiments. Graph 600 includes a horizontal axis 602 representing voltage and a vertical axis 604 representing brightness. Curve 606 transitions from a maximum value indicated at 610 to a minimum value indicated at 620. The voltage can be a Vin voltage from a dimmer or signal detection unit.

FIG. 7 illustrates a relationship between a dimmer signal, and brightness/power/current of three light-emitting devices in accordance with embodiments of the present invention. Graph 700 includes a horizontal axis 702 representing voltage and a vertical axis 704 representing BIP (Brightness B, Current I, and Power P). In the present examples, I, P and B are proportional to each other, so that a single graph 700 suffices to characterize all of them with vertical axis 704 representing all three parameters (B, I, P). Curve 714 represents BIP for a first light-emitting device (132 or 232). Curve 716 represents BIP for a second light-emitting device (134 or 234). Curve 718 represents BIP for a third light-emitting device (136 or 236).

The voltage can be a Vin voltage from a dimmer or signal detection unit. The three curves 714, 716, and 718 represent independent control of light-emitting devices 132, 134, and 136 (or 232, 234, and 236). By independently controlling the light-emitting devices, a wide variety of brightness levels and/or CCT values are possible in disclosed embodiments.

FIG. 8 shows a combined brightness, current, and power curve in accordance with embodiments of the present invention. Graph 800 includes a horizontal axis 802 representing voltage and a vertical axis 804 representing BIP (Brightness B, Current I, and Power P). In the present examples, I, P and B are proportional to each other, so that a single graph 800 suffices to characterize all of them with vertical axis 804 representing all three parameters (B, I, P). Curve 814 represents BIP for a first light-emitting device (132 or 232). Curve 816 represents BIP for a second light-emitting device (134 or 234). Curve 818 represents BIP for a third light-emitting device (136 or 236).

The voltage can be a Vin voltage from a dimmer or signal detection unit. The three curves 814, 816, and 818 represent independent control of light-emitting devices 132, 134, and 136 (or 232, 234, and 236). The combined light from each of the three light-emitting devices shown in FIG. 8 forms combined BIP output shown in curve 821. The combined BIP output comprises a constant region 827, and a variable region 829.

FIG. 9 shows a relationship between a dimmer signal, brightness/power/current, and a correlated color temperature in some embodiments. Graph 900 includes a horizontal axis 902 representing voltage and a vertical axis 904 representing BIP (Brightness B, Current I, and Power P) and CCT. The voltage can be a Vin voltage from a dimmer or signal detection unit. Curve 914 represents a combined BIP (combined brightness, combined current, and combined power) output of the apparatus. Curve 916 represents a combined-light CCT of the apparatus.

As can be seen in graph 900, there is a first region 922 in which the CCT is constant, while the BIP varies. There is a second region 924 in which both the CCT and the BIP vary. There is a third region 926 in which the BIP is constant while the CCT varies.

Thus, in embodiments, the special dimming signal can be divided into 3 parts, a lower part (922), a middle part (924), and an upper part (926). The brightness, power and current of the corresponding light-emitting devices have the following corresponding relationships: In the upper part, the brightness, power and current of the lamp remain basically constant, but the color temperature is changing. In the middle part, the brightness, power, current and color temperature of the lamp are all changing. In the lower part, the brightness, power, and current of the lamp are changing, and the color temperature remains stable. In embodiments, the microcontroller (110 or 210) adjusts the output of the light-emitting devices based on input signals from user input devices such as dimmer (104 or 204) and/or user interface (112/212), and may further use information in lookup tables, and/or formulas stored in a computer-readable medium within the microcontroller. In some embodiments, the controller is configured to distribute supply power to the first light-emitting device, second light-emitting device, and third light-emitting device according to a power-distribution scheme that differentiates between whether Vin is in a first range, second range, or a third range, such that: in the first range, brightness of the first, second, and third light-emitting devices varies, and the combined-light CCT is constant; in the second range, brightness of the first, second, and third light-emitting devices varies, and the combined-light CCT varies; and in the third range, brightness of the first, second, and third light-emitting devices is constant, and the combined-light CCT varies As can now be appreciated, disclosed embodiments provide an improved, adjustable LED lamp device. The device includes a first LED light, a second LED light, and a third LED light. Each LED light has a different CCT value. Three kinds of LED lights combine to form a combined CCT and brightness. The device also includes an LED driver, which is connected to a dimmer. The driver includes a signal receiving unit, a centralized control unit (microcontroller), an optional setting interface, and current control modules for each LED light. The special driving device can be decomposed into any cavity part, and the receiving unit, microcontroller, optional setting interface and 3 current control modules can be separately installed in another shell.

When the dimmer signal changes, the signal receiving unit detects the signal and processes it by a microcontroller. Through the 3-way current control module, the size and proportion of the 3-way current can be changed, so as to realize the change of brightness and color temperature.

The optional setting interface can set the desired color temperature range and mode. Some embodiments may include additional lighting devices. Some embodiments may have a fourth light-emitting device to create a 4-way device. In general, embodiments can include an N-way device, where N is a number greater than or equal to 3.

Although the invention has been shown and described with respect to a certain preferred embodiment or embodiments, certain equivalent alterations and modifications will occur to others skilled in the art upon the reading and understanding of this specification and the annexed drawings. In particular regard to the various functions performed by the above described components (assemblies, devices, circuits, etc.) the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more features of the other embodiments as may be desired and advantageous for any given or particular application.

What is claimed is:

1. An apparatus comprising:

a dimmer configured and disposed to provide an input signal to an LED driver;

a signal detection unit configured and disposed to receive an output signal from the LED driver;

a controller configured to provide power to:

a first light-emitting device that is configured to emit a first white light of a first correlated color temperature (CCT);

a second light-emitting device that is configured to emit a second white light of a second CCT;

a third light-emitting device that is configured to emit a third white light of a third CCT, wherein the light from the first, second, and third light-emitting devices mix to form a combined-light CCT;

receive an output signal from the signal detection unit, wherein the output signal from the signal detection unit is proportional to the input signal provided by the dimmer;

in response to receiving a user-adjustable electronic signal Vin from the signal detection unit, adjusting output current of a first current control module, wherein the first current control module is electrically coupled to the first light-emitting device, adjusting output current of a second current control module, wherein the second control module is electrically coupled to the second light-emitting device, and adjusting output current of a third current control module, wherein the third current control module is electrically coupled to the third light-emitting device, and wherein the first current control module, second current control module, and third current control module are each adjustable independently; and distribute supply power to the first, second, and third light-emitting devices according to a power-distribution scheme that is based on the level of Vin; and wherein the controller is configured to distribute supply power to the first light-emitting device, second light-emitting device, and third light-emitting device according to a power-distribution scheme that differentiates between whether Vin is in a first range, second range, or a third range, such that:

the brightness of the first light-emitting device decreases as a function of increasing Vin;

the brightness of the second light-emitting device increases for a first region of increasing Vin, and decreases for a second region of increasing Vin, wherein the second region is adjacent to the first region; and the brightness of the third light-emitting device remains constant for a third region of increasing Vin, and decreases for a fourth region of increasing Vin.

2. The apparatus of claim 1, further comprising a CCT user control configured and disposed to provide an input signal to the controller.

3. The apparatus of claim 2, wherein the user control comprises a plurality of preset CCT buttons.

4. The apparatus of claim 3, wherein the plurality of preset CCT buttons include 2700K, 3000K, 3500K, 4000K, and 5000K.

5. The apparatus of claim 1, wherein the dimmer includes a slider control.

6. The apparatus of claim 1, further comprising a wireless communication interface coupled to the dimmer.

7. The apparatus of claim 6, wherein the wireless communication interface includes a Wi-Fi interface.

8. The apparatus of claim 6, wherein the wireless communication interface includes a Bluetooth interface.

9. The apparatus of claim 6, wherein the wireless communication interface includes an infrared interface.

10. An apparatus comprising:

a dimmer configured and disposed to provide an input signal to an LED driver;

a signal detection unit configured and disposed to receive an output signal from the LED driver;

a controller configured to provide power to:

a first light-emitting device that is configured to emit a first white light of a first correlated color temperature (CCT);

a second light-emitting device that is configured to emit a second white light of a second CCT;

a third light-emitting device that is configured to emit a third white light of a third CCT;

receive an output signal from the signal detection unit, wherein the output signal from the signal detection unit is proportional to the input signal provided by the dimmer;

in response to receiving a user-adjustable electronic Vin signal from the signal detection unit, adjusting output current of a first current control module, wherein the first current control module is electrically coupled to the first light-emitting device, adjusting output current of a second current control module, wherein the second control module is electrically coupled to the second light-emitting device, and adjusting output current of a third current control module, wherein the third current control module is electrically coupled to the third light-emitting device, and wherein the first current control module, second current control module, and third current control module are each adjustable independently; and distribute supply power to the first, second, and third light-emitting devices according to a power-distribution scheme that is based on the level of Vin, and wherein the signal detection unit, first current control module, second current control module, and third current control module are integrated into a single device; and wherein the controller is configured to distribute supply power to the first light-emitting device, second light-emitting device, and third light-emitting device according to a power-distribution scheme that differentiates between whether Vin is in a first range, second range, or a third range, such that:

the brightness of the first light-emitting device decreases as a function of increasing Vin;

the brightness of the second light-emitting device increases for a first region of increasing Vin, and decreases for a second region of increasing Vin, wherein the second region is adjacent to the first region; and the brightness of the third light-emitting device remains constant for a third region of increasing Vin, and decreases for a fourth region of increasing Vin.

11. The apparatus of claim 10, further comprising a CCT user control configured and disposed to provide an input signal to the controller.

12. The apparatus of claim 11, wherein the CCT user control comprises a plurality of preset CCT buttons.

13. The apparatus of claim 12, wherein the plurality of preset CCT buttons include 2700K, 3000K, 3500K, 4000K, and 5000K.

14. The apparatus of claim 10, wherein the dimmer includes a slider control.

15. The apparatus of claim 10, further comprising a wireless communication interface coupled to the dimmer.

16. The apparatus of claim 15, wherein the wireless communication interface includes a Wi-Fi interface.

17. The apparatus of claim 15, wherein the wireless communication interface includes a Bluetooth interface.

18. The apparatus of claim 15, wherein the wireless communication interface includes an infrared interface.

* * * * *